United States Patent [19]

Timblin

[11] 4,117,465

[45] Sep. 26, 1978

[54] ALARM SYSTEM FOR VENDING MACHINES

[76] Inventor: Stanley W. Timblin, #4 Forest Hill Ct., Greensboro, N.C. 27410

[21] Appl. No.: 785,588

[22] Filed: Apr. 7, 1977

[51] Int. Cl.[2] ..... G08B 13/08

[52] U.S. Cl. ..... 340/545; 200/61.93

[58] Field of Search ..... 340/274 R; 200/61.93, 200/61.81, 61.64, 61.67

[56] References Cited

U.S. PATENT DOCUMENTS

| | | | |
|---|---|---|---|
| 2,170,521 | 8/1939 | Rodth | 340/274 R |
| 3,852,737 | 12/1974 | Gordon | 340/274 R |
| 4,052,718 | 10/1977 | Tucci et al. | 340/274 R |

*Primary Examiner*—Glen R. Swann, III

[57] ABSTRACT

A plurality of door/cabinet separation responsive, alarm triggering switches are positioned at spaced points along the interface between the door and cabinet edge, preferably near the top and bottom of the edge opposite the hinged edge where the cabinet and door are joined. The switches are arranged in parallel with each other in a warning circuit, in such a manner that the slightest separation between the free edge of the door and cabinet at any point above or below the latch will cause one of the switches to activate the alarm system.

A circuit arming switch is activated and released responsive to a closing or opening of the fastening lever of the door to automatically arm and disarm the alarm circuit. When the door is opened or closed by an authorized person, the arming mechanism disarms or arms the system automatically. Also, the circuitry is such that once the alarm is fired, it cannot be disarmed without a special tool placed at a special location, which is not apparent to an unauthorized entrant.

3 Claims, 5 Drawing Figures

ALARM SYSTEM FOR VENDING MACHINES

BACKGROUND OF THE INVENTION

During recent years, the machine vending of various goods has expanded considerably to the extent that now many vending machines are placed in outside locations that are unattended and unlocked, at least most of the time. The temptation for burglary and simple vandalism is a considerable problem in the industry to such an extent that several burglar alarms or tampering warning systems have been proposed. Although burglary of the machines and larceny of either the money or goods from the machine is a problem, a much greater problem is the damage to the vending machine itself which occurs during the break in, and which causes a considerably greater economic loss than the amount of goods or money which is taken from the machine at any particular time.

The general approach of the vandal or the unsophisticated burglar is to try to pry open the door with a crow bar or other lever means. Most of the alarms proposed to date are triggered by a switch at either the bottom or top of the door which is set off when the door separates from the cabinet edge. However, if the burglar or vandal is attempting to pry open the door at a point below the latch, and if the alarm switch is above the latch, the alarm may not be triggered at all, or else by the time the alarm is triggered, several hundred dollars worth of damage to the machine and door may have occurred. It is not sufficient to provide an alarm that requires opening of the door at all points around the edge to insure triggering of the alarm, because by that time the damage has been done.

Other problems include the means by which the alarm circuit is armed at the outset. Generally, the alarm circuit is armed by a separate key which makes arming of circuit not only time consuming, but sometimes possibly overlooked by the attendant. Also, alarms, even though fired, may be quickly shut off once the vandal or burglar gains access to the inside of the cabinet.

SUMMARY OF THE PRESENT INVENTION

In the alarm system according to the present invention, however, an attempt is made to overcome the problems set forth hereinabove. First of all, the plurality (at least two) of triggering switches, responsive to the slightest separation of the door, are placed at spaced positions along the interface of the free edges of the door. For example, one switch is placed considerably above the latch near the top, while a second switch may be placed considerably below the latch nearer the bottom. Then no matter whether the burglar or vandal attempts to pry open the door from the upper or lower portion, the alarm will be sounded prior to the time excessive damage is done to the door.

It should be remembered that in most cases the unsophisticated vandal or burglar is being dealt with and the sounding of the alarm is going to scare him off. Therefore if the alarm can be sounded prior to the time the damage occurs, chances are good that there will be no damage at all.

A third switch or arming switch is positioned in the path of the fastening lever of the door and is activated to arm the alarm circuit responsive to the turning of the lever which fastens the door securely closed. The turning of the lever is the last step performed in closing of the door and the first step performed in opening of the door. Therefore, a simple lever activated, push-button, "on-off" switch, which is in the path of the lever, will suffice to automatically arm the circuit when the door is closed by the attendant and disarm the circuit when the door is opened by an authorized person.

Further, in the circuit according to the present invention, once the alarm is fired it cannot be disarmed by reengaging the arming switch or the triggering switches. In other words, a silicon controlled rectifier in the circuit maintains current to the warning device, and it cannot be disabled by reclosing the switches or cutting wires. It can only be disarmed through a completely hidden reset switch which is engagable only by a special tool with which the unsophisticated vandal or burglar will not be familiar.

It is therefore an object of the present invention to provide an alarm system for vending machines that overcomes the problems realizes heretofore.

It is another object of the present invention to provide an alarm system for vending machines that is so designed as to be triggered responsive to the slightest separation of the door from its cabinet at any point around the periphery or interface thereof so that damage to the equipment can be obviated.

It is yet a further object of the present invention to provide an alarm system for vending machines of the type described in which the alarm circuitry is automatically armed and disarmed responsive to closing or opening of the door by the attendant.

It is yet another object of the present invention to provide an alarm system for vending machines of the type described in which, once triggered, the alarm cannot be disarmed other than by a person familiar with the system and having the proper tool.

BRIEF DESCRIPTION OF THE DRAWINGS

Other objects and a fuller understanding of the invention will become apparent from reading the following detailed description of a preferred embodiment along with the accompanying drawings in which.

DETAILED DESCRIPTION OF A PREFERRED EMBODIMENT

Figure 1:
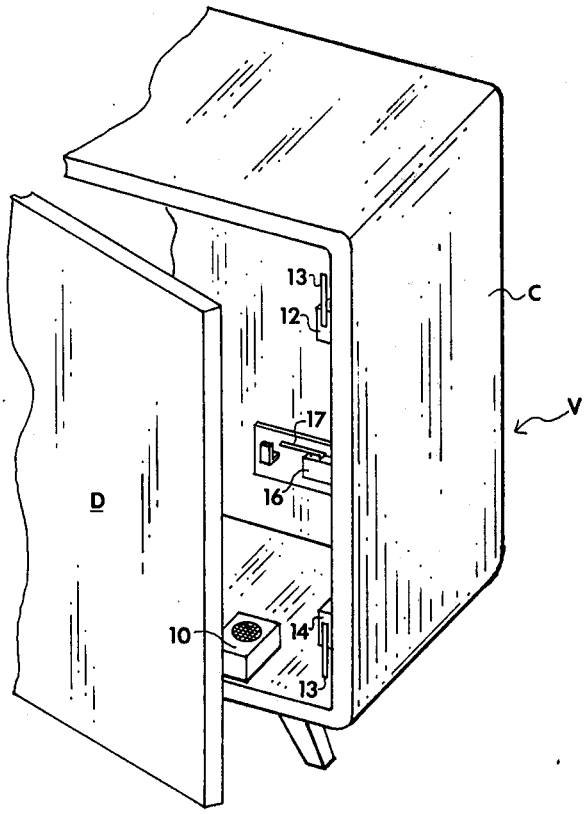
FIG. 1 is a perspective view of one side of a vending machine, with parts broken away, and illustrating the door slightly open showing the relative positioning of the triggering switches and arming switch.

Turning now to the drawings, and particularly to FIG. 1, there is illustrated in general a vending machine V of the type with which the present invention is intended for use. Vending machine V includes a cabinet portion C and a door D hinged along one edge (not shown) thereof. In general, the invention includes a warning device 10 mounted appropriately either outside or inside the vending cabinet C and being electrically connected to a plurality of triggering switches 12,14 positioned at spaced points in operative relationship between the edge of the cabinet C and the corresponding edge portion of the door D for activation responsive to the slightest separation of the door from the cabinet. As illustrated in FIG. 1 at least two of such spaced positions are shown relatively adjacent either end (the top and bottom) of the edge of the door and cabinet opposite the hinge side. An electrical circuit (FIG. 4) connects the switch means 12,14 in parallel with each other between a power source and the aforementioned warning device 10, so that the warning device is activated responsive to activation of one of switches 12,14.

Figure 5:
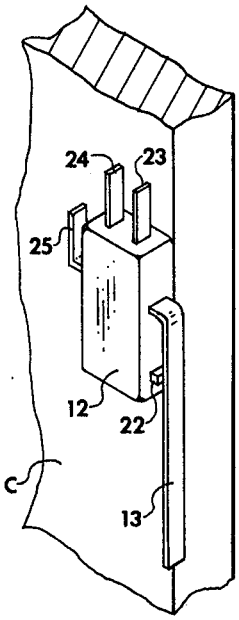
FIG. 5 is an enlarged perspective view, with parts broken away, illustrating the position of one of the triggering switches relative to the side wall of the cabinet.

Switches 12 and 14 are illustrated in FIGS. 1 and 5 to be mounted to the inside of the cabinet C flush against the front edge thereof, one near the top and one near the bottom. It is obvious that the switches could also be mounted in similar positions along the top and bottom edge, near the corner thereof, rather than along the upright portion. Further, more than two switches could be utilized to obtain even better results; however, it is believed that two will suffice in most situations. Switches 12 and 14 are so mounted along the inside surface of the cabinet that the operating arm 13 thereof is alternately engaged and released as the door opens and closes. (See FIG. 5). In an alternate approach the switches 12,14 could be mounted to the door with the operating arm 13 in the interface between the door and cabinet edge.

Figure 2:
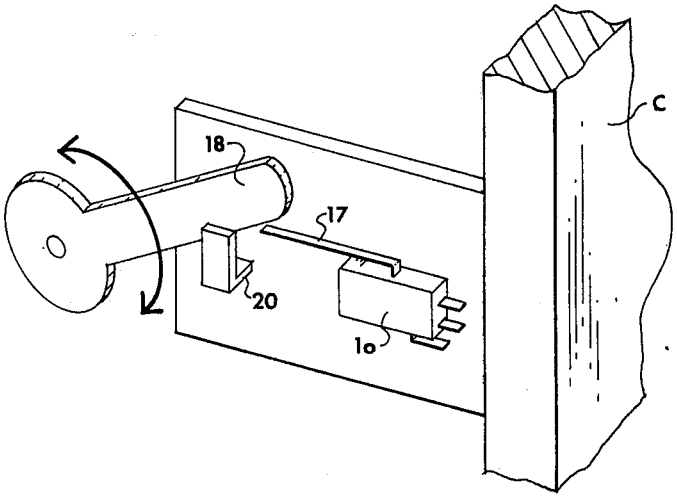
FIG. 2 is an enlarged perspective view with parts broken away illustrating the positioning of the arming switch relative to the fastening lever of the door.

A second type of switch, for arming switch 16, is secured within the cabinet C at such a position that that activating arm 17 thereof is in the path of the fastening lever 18 of door D which secures the door to the cabinet in the closed position by being turned into engagement with a latch means 20 (FIG. 2). When the lever 18 is securely latched, it engages the actuating arm 17 of the arming switch 16 to arm the circuit so that any attempt to gain entrance without releasing lever 18 will set off the alarm. Conversely, when an authorized attendant opens the door the first move is to disengage lever 18 from latch 20, which releases the actuating arm 17 of arming switch 16. This occurs at a time prior to any opening of the door so that the warning circuit is disarmed prior to an authorized entry.

Figure 3:
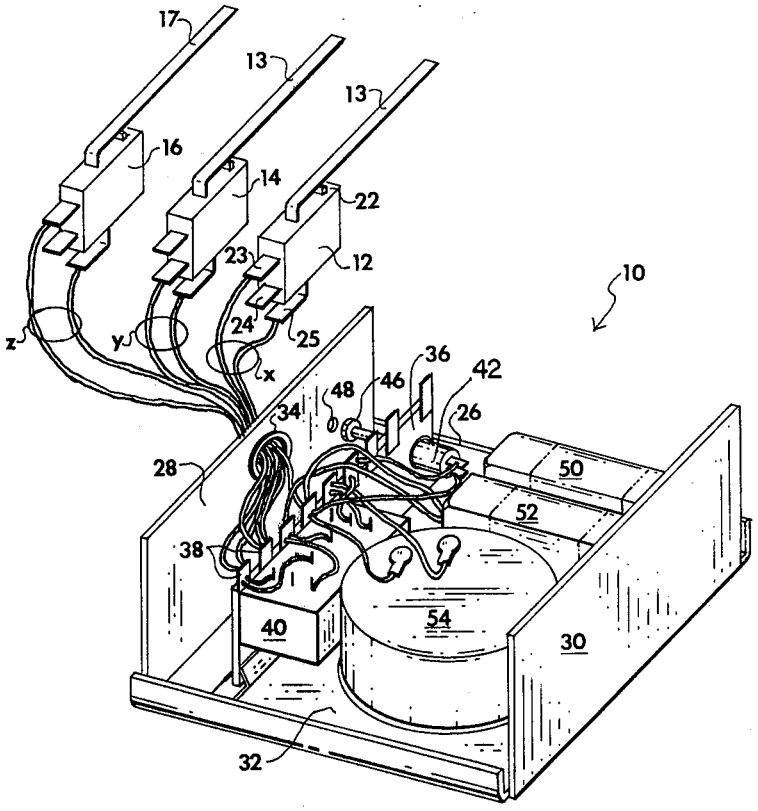
FIG. 3 is a perspective view illustrating the alarm device itself with its accompanying electrical components.
Figure 4:
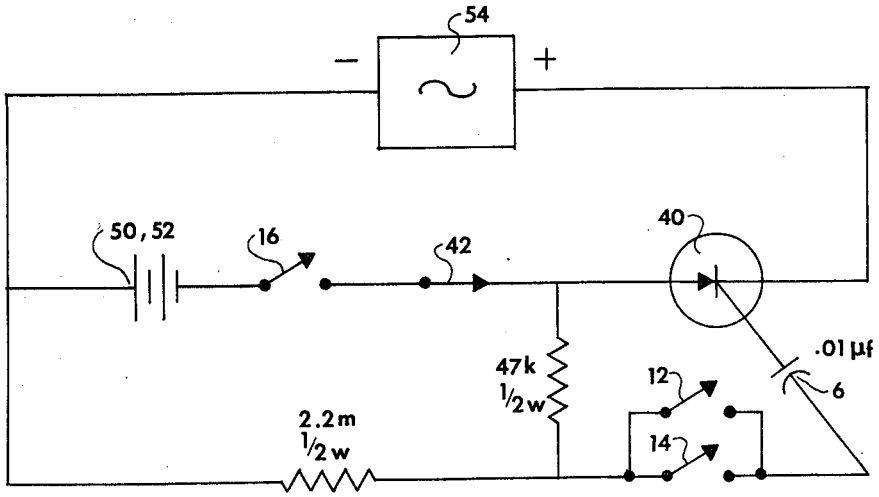
FIG. 4 is an electrical schematic illustrating the circuit of the present invention.

Turning now to FIG. 3, there is illustrated the components which make up the warning device 10. A housing 26 includes a pair of end walls 28,30, a bottom wall 32, and a removable cover not shown. An opening 34 in end wall 28 provides access into the housing for a plurality of wire pairs X,Y,Z leading from the switches 12,14 and 16. A terminal board 36 having a plurality of upstanding lugs 38 is mounted on base 32 and provides a means for connecting the wire pairs X,Y,Z with the various elements within housing 10. A silicon controlled rectifier (SCR) 40 is mounted to the base 32 of housing 26 and electrically connected between the various components as illustrated in FIG. 4. The alarm shut off switch 42 is mounted on terminal board 36 and includes an activating plunger 46 disposed immediately behind a small opening 48 in end wall 28. To shut the system off, once it has been tripped, it is necessary to insert a small tool through opening 48 and depress plunger 46. A pair of batteries 50,52 provide the power source for the system and the warning device is preferably a loud electric siren 54 of the type which produces 90 decibles at 10 feet, thereby tending to scare vandals and burglars away with a police type sound. It is obvious that other types of warning signals could be used, such as buzzers, horns, sirens, bells, gongs, lights, and the like.

Each of the three switches 12,14 and 16 are similar with the only difference being in the wiring and placement thereof. Looking at FIG. 3, each of such switches includes an actuating lever or arm 13 (or 17 in the case of switch 16), which when depressed, engages a plunger 22 in the casing adjacent thereto. The plunger 22 then internally connects an electrical circuit between the various lugs 23,24, and 25, which may be wired as required.

Turning now to the circuit diagram in FIG. 4, power supplied from batteries 50,52, which, upon activation of the arming switch 16 provides a signal to one side of the SCR. Upon activation of either trigger switch 12 or 14, voltage is also applied to the gate of the SCR to cause it to conduct, whereupon the alarm sounds. Even though an opening of the door would deactivate switch 16, an alarm continuation means in the form of the triggered SCR, maintains the sounding of the alarm until the reset switch 42 is engaged to break the circuit.

There is thus provided an improved alarm system for vending machines that does a better job of protecting the equipment, is automatically armed, and more difficult to shut off for the unauthorized vandal or burglar than those known heretofore. Although a preferred embodiment of the invention has been shown and described in detail hereinabove, it is evident that various changes and modifications could be made without departing from the scope of the invention which is set forth in the accompanying claims.

What is claimed is:

1. An improved alarm system for vending machines of the type having a cabinet, a front closure door hinged along one edge to a corresponding front edge of said cabinet, and said door and cabinet including a latch means associated therewith for securely fastening said door to said cabinet; said system comprising:

a. a power source;

b. an electrically operated warning signal device;

c. an electrical circuit connecting said power source and signal device;

d. a plurality of triggering switch means positioned at spaced points in operative relationship between said cabinet and said door for activation responsive to separation of said door and cabinet, at least two of said spaced positions being relatively adjacent either end of the edge of said door and cabinet opposite the hinge side thereof;

e. said switch means arranged in parallel with each other in said circuit between said power source and said signal device, and said signal device being operated responsive to activation of one of said switches;

f. whereby the slightest separation of said door from said cabinet at either end of said free edge activates said warning signal device.

2. The alarm system according to claim 1 and further including an arming switch means mounted in the path of said latch means for arming said circuit automatically responsive to a latching of said door.

3. The alarm system according to claim 2 wherein said circuit includes a reset switch and an alarm continuation means for continuing the alarm once set off until said reset switch is activated, said reset switch being positioned in a substantially inaccessible location and activated only by means of a reset tool.

* * * * *